US008584361B2

(12) United States Patent
McFerren

(10) Patent No.: US 8,584,361 B2
(45) Date of Patent: Nov. 19, 2013

(54) BODY JEWELRY APPLICATOR

(76) Inventor: Garrick P. McFerren, Uniontown, OH (US)

( * ) Notice: Subject to any disclaimer, the term of this patent is extended or adjusted under 35 U.S.C. 154(b) by 147 days.

(21) Appl. No.: 13/226,976

(22) Filed: Sep. 7, 2011

(65) Prior Publication Data

US 2013/0055570 A1 Mar. 7, 2013

(51) Int. Cl.
*A44C 27/00* (2006.01)

(52) U.S. Cl.
USPC ..... 29/896.42; 29/896.4; 29/896.41; 24/587.1; 24/587.11; 63/12; 63/14.1

(58) Field of Classification Search
USPC ..... 29/896.4–896.43; 24/587.1, 587.11; 63/12, 14.1
See application file for complete search history.

(56) References Cited

U.S. PATENT DOCUMENTS 4,246,679 A * 1/1981 Monett ..... 24/587.11

* cited by examiner

*Primary Examiner* — Richard Chang
(74) *Attorney, Agent, or Firm* — Renner, Kenner, Greive, Bobak, Taylor & Weber Co., L.P.A.

(57) ABSTRACT

A body jewelry applicator includes a gripping member adapted to receive and retain the backing of a piece of body jewelry within a hole or opening. The gripping member may be made of a foam and have one or more holes in the ends thereof for receiving the backing. The body jewelry applicator may also include a body or handle to which the gripping member is secured. A release rod may be slidably positioned within the body and movable between a first position and a second position, movement of the release rod from the first position to the second position causing the release rod to engage and expel the backing from the gripping member.

8 Claims, 2 Drawing Sheets

BODY JEWELRY APPLICATOR

FIELD OF THE INVENTION

The present invention relates generally to an applicator for body jewelry. More specifically, the present invention relates to a body jewelry applicator having a gripping portion adapted to hold and support a piercing backing.

BACKGROUND OF THE INVENTION

Body piercing, which is a form of body modification, is the practice of puncturing the human body to create an opening for jewelry to be inserted. The term piercing refers to both the act of creating the opening in the body and the opening itself. Ear piercing is the most common type of body piercing, and has been popular for quite some time. However, other types of body piercings have become more popular and socially accepted in recent years, including nose piercings, naval piercings, lip piercings, tongue piercings, and eyebrow piercings.

Body jewelry, such as an ear ring, that is worn in body piercings typically includes a decorative jewelry portion and a backing portion. The decorative jewelry often includes a stem or shaft that extends through the piercing in a person's body, and the backing is received at an end of the stem or shaft after insertion of the jewelry to prevent the jewelry from falling out. The backing of the jewelry may be retained on the stem by friction, or it may be threaded onto the stem. In either case, securing the backing to the jewelry, and to a lesser extent removal of the backing, can be difficult and frustrating due to the small size of the backing. Aligning the backing with the stem and securing the backing onto the stem is often not easily accomplished due to the positioning of the jewelry on the body.

Thus, there is a need for a body jewelry applicator or tool that makes securing a backing to a piercing easier and less time consuming.

SUMMARY OF THE INVENTION

In general, a body jewelry applicator according to the present invention includes a foam gripping member having opposing ends, and a hole in one of said ends adapted to receive and retain a jewelry backing therein.

In accordance with at least one aspect of the present invention, a body jewelry applicator includes a body adapted to be gripped by a user, and a gripping member releasably secured to said body and adapted to hold and retain a jewelry backing.

In accordance with at least one aspect of the present invention, a method of installing body jewelry includes positioning a jewelry backing in a gripping member of a body jewelry applicator, aligning the backing with the body jewelry using the applicator, securing the backing to the body jewelry using the applicator, and releasing the backing from the gripping member.

BRIEF DESCRIPTION OF THE DRAWINGS

For a full understanding of the invention reference should be made to the following detailed description and the accompanying drawings, wherein.

DETAILED DESCRIPTION OF THE ILLUSTRATIVE EMBODIMENTS

Figure 1:
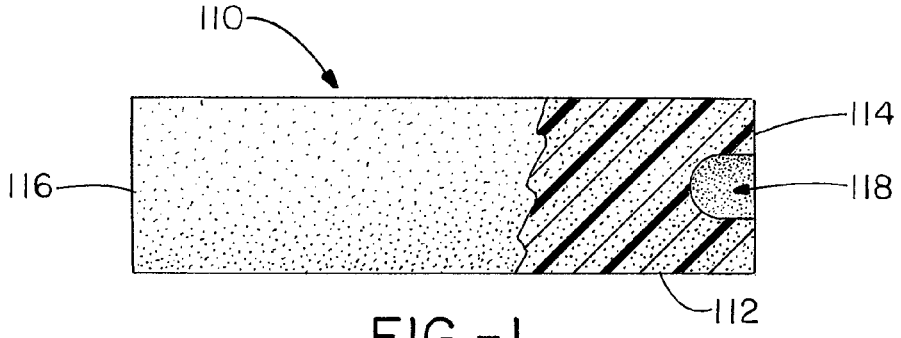
FIG. 1 is section view of a first embodiment of the body jewelry applicator according to the concepts of the present invention.

Referring now to FIG. 1, an applicator for body jewelry is shown, generally indicated by the numeral 110. Body jewelry applicator 110 is designed and intended to assist in the fastening or unfastening of the backings of body jewelry. Body jewelry applicator 110 includes a gripping member 112, which may be generally cylindrical in shape. However, it is also contemplated that the gripping member 112 may be provided in other shapes or forms as desired. For example, in other embodiments, the gripping member 112 may have a rectangular cross section.

In certain embodiments of the invention, the gripping member 112 may have a length of between approximately 0.25 and 2.5 inches. The gripping member 112 includes a first end 114 and a second end 116 located at opposing sides of the gripping member 112. In one or more embodiments, the gripping member 112 of the body jewelry applicator 110 may be made of a foam material. The foam material has sufficient elasticity to allow the gripping member 112 to deform slightly, as is known to those skilled in the art.

A hole 118 is provided in the first end 114 and extends into the gripping member 112 toward the second end 116. The diameter and depth of the hole 118 varies, depending upon the size of the backing to be held or gripped by the body jewelry applicator 110. The hole 118 is sized to have a diameter slightly less than the diameter of a backing to be gripped by the body jewelry applicator 110, and a depth that is approximately equal to or larger than the diameter of the backing. For example, in certain embodiments, the hole 118 may have a diameter of between approximately 0.1 and 0.5 inches. The gripping member 112 deforms to allow insertion of the backing into the hole 118, and the slightly smaller hole acts to grip or hold the backing within the body jewelry applicator 110.

In certain embodiments, a second hole (not shown) may be provided in the opposite end of the gripping member, the second hole having a diameter different from that of the hole 118. The inclusion of two holes of different diameters allows a single body jewelry applicator to receive backings of two different sizes.

In use, a backing for a piece of body jewelry is pressed into the hole 118 of body jewelry applicator 110, which deforms slightly to accommodate the larger backing and retains the backing in place. The gripping member 112 can then be gripped by a person to align the backing with the shaft or stem of the jewelry. The backing is then secured onto the stem or shaft of the jewelry by turning the backing, in the case of a threaded connection, or by simply pressing the backing onto the shaft in the case of a friction fit.

As will be appreciated by those who have experience with jewelry of this type, the ability to grasp the larger body jewelry applicator 110, rather than attempting to grasp the backing alone, will make the process of fastening the backing to the jewelry easier and less time consuming. Once the backing is secured to the jewelry, the gripping member 112 of body jewelry applicator 110 is squeezed adjacent to the hole 118, which causes the body jewelry applicator 110 to release the backing. It is contemplated that the body jewelry applicator 110 may be provided in sets or kits that include a plurality of gripping members 112 having holes 118 of varying sizes.

Figure 2:
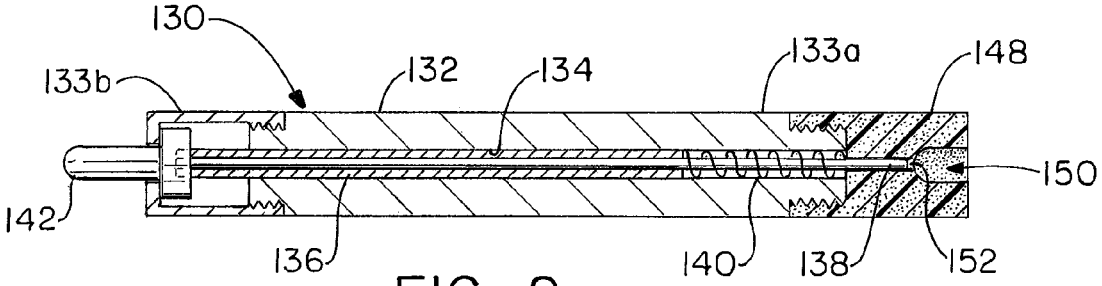
FIG. 2 is a section view of another embodiment of the body jewelry applicator according to the concepts of the present invention.
Figure 3:
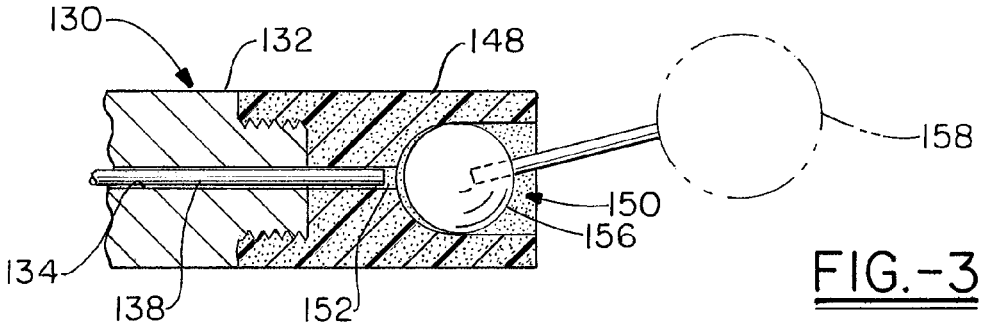
FIG. 3 is an enlarged section view of a gripper portion of the body jewelry applicator as shown in FIG. 2 with a jewelry backing of a piece of body jewelry positioned within the gripper portion.
Figure 4:
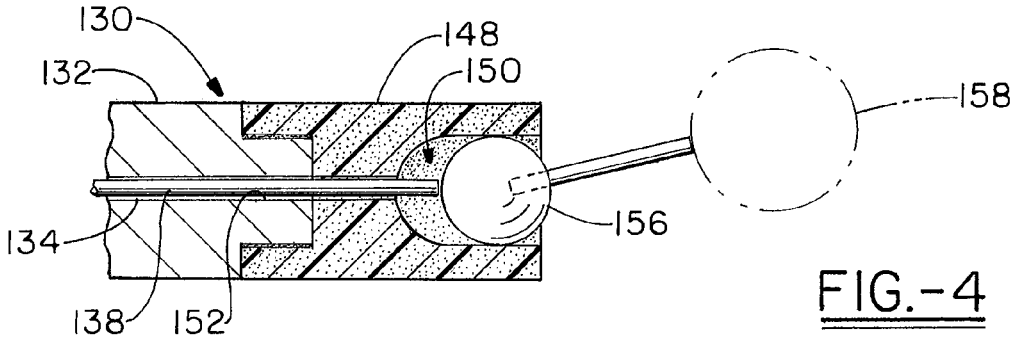
FIG. 4 is a section view of the gripper portion of FIG. 3 with the backing engaged by a release rod.

Referring now to FIGS. 2-4, another embodiment of an applicator for body jewelry according to the concepts of the present invention is shown, and is indicated generally by the numeral 130. Body jewelry applicator 130 includes a body 132 having a forward end 133*a* and a rear end 133*b*. The body 132 is generally cylindrical in shape with a longitudinally extending bore 134 positioned concentrically therein. A sleeve 136 is positioned within a portion of bore 134, and a release rod 138 extends through the sleeve 136 and the bore 134, and extends substantially the entire length of body 132 between ends 133*a* and 133*b*. The sleeve 136 and release rod 138 are operatively engaged so that movement of release rod 138 within bore 134 also causes movement of sleeve 136. A spring 140 is positioned adjacent to a first end of sleeve 136 to bias the sleeve 136 and release rod 138 toward rearward end 133*b*. It is also contemplated that outwardly extending projections (not shown) may be provided on release rod 138 in lieu of the sleeve 136, the projections providing an engagement point for the biasing spring 140, as will be appreciated by those skilled in the art.

A push button 142 is located at the rear end 133*b* of the body 132 and is operatively engaged with the release rod 138 so that movement of the push button 142 causes movement of the release rod 138. The release rod is movable between a first retracted position (FIG. 3) and a second extended position (FIG. 4) and operates similar to known retractable pens. A third fully extended position may be reached at full depression of the push button 142 where the release rod 138 extends further than the second extended position. Mechanisms to accomplish the retractable movement of the release rod 138 are well known, and may include a heart shaped cam mechanism such as that disclosed in U.S. Pat. No. 3,334,615, which is incorporated herein by reference for the purpose of teaching a suitable cam mechanism.

A gripping member 148 is received on the forward end 133*a* of the body 132. In the embodiment depicted in the drawings, the gripping member 148 is secured to the body 132 by a threaded connection, but it is contemplated that other methods of connecting the gripping member to the body 132 may be used. For example, the gripping member 148 may also be secured to the body 132 by a press fitting, as shown in FIG. 4. Gripping member 148 is made of foam or other materials having a degree of elasticity.

Figure 5:
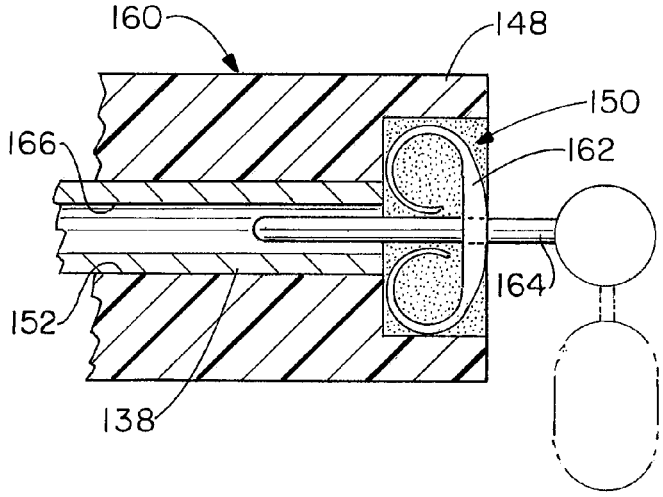
FIG. 5 is a section view of another embodiment of the body jewelry applicator according to the concepts of the present invention.

The gripping member 148 includes a hole 150 sized to receive and retain a backing of a piece of body jewelry. As with the hole 118 of body jewelry applicator 110 discussed above, the hole 150 is sized to be slightly smaller than the backing so that the gripping member deforms around the backing to retain the backing within the hole. The gripping member 148 also includes a through-bore 152 that extends from the hole 150 toward the body 132 and is aligned with the release rod 138. The through-bore 152 receives the release rod 138 therein. In the first retracted position, as shown in FIGS. 2-3, the release rod 138 does not extend into hole 150, but has an end positioned adjacent to the hole. In the second extended position, as shown in FIG. 5, the release rod 138 extends into the hole 150 to engage and expel the backing. In certain embodiments, a single body jewelry applicator 130 may be provided as part of a kit along with multiple gripping members 148 having varying sizes of holes 150 to accommodate a plurality of body jewelry sizes and backings. It is also contemplated that gripping member 148 may include a hole 150 extending entirely therethrough, thereby alleviating the need for a through-bore to accommodate release rod 138. In such an embodiment, the release rod 138 would extend into the hole in the first retracted position and would act as a stop for a backing pressed into the gripping member.

In use, a backing 156 (FIGS. 3 and 4) of a piece of body jewelry is pressed into the hole 150 in the gripping member 148, and the body jewelry applicator 130 is then held in position to align the backing 156 with the shaft or stem of the jewelry 158. In the case of a threaded backing, the body jewelry applicator 130 may be rotated to secure the backing 156 to the shaft or stem. Once the backing 156 is secured to the stem of the body jewelry 158, the push button 142 may be pressed to cause the release rod 138 to extend into the hole 150 in the gripping member 148. As shown in FIG. 4, movement of the release rod 138 into the hole 150 causes the release rod to engage the backing 156 and push it from the hole, thereby overcoming the gripping force applied by the gripping member 148.

Figure 6:
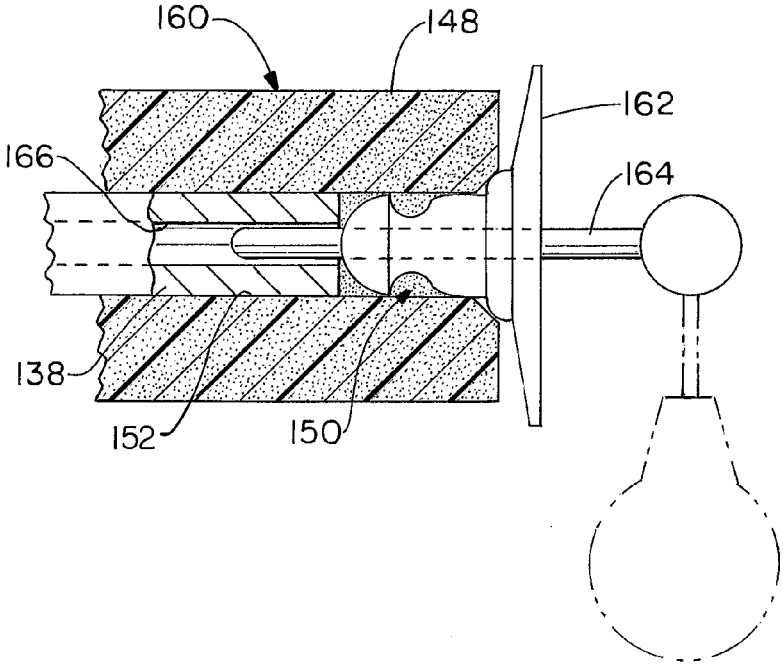
FIG. 6 is a section view of the body jewelry applicator of FIG. 5 designed to accommodate an alternative piece of body jewelry.

Referring now to FIGS. 5 and 6, an alternate embodiment of the body jewelry applicator is shown and is generally indicated by the numeral 160. Body jewelry applicator 160 is substantially identical to body jewelry applicator 130 discussed above. Therefore, like components in body jewelry applicator 160 are numbered accordingly.

Body jewelry applicator 160 is designed for use with body jewelry, and specifically ear rings, that include a backing 162 that is secured to the stem 164 with a friction fit. As can be seen in FIG. 6, the stem 164 extends through the backing 162 when inserted. The only significant difference between the body jewelry applicator 160 and the body jewelry applicator 130 is a bore 166 provided in the release rod 138. The bore 162 is positioned concentrically within the release rod 138 and allows the stem 164 to extend beyond the depth of the hole 150. When a push button is pressed to cause the release rod 138 to extend into the hole 150, the release rod contacts the backing 162 without contacting the stem 164, thereby ensuring that both the backing and jewelry are expelled from the hole 150 and not just the jewelry. The dimensions of the griping member 148 and hole 150 may be adapted to accommodate various sizes and shapes of backings 162, as illustrated in the different body jewelry of FIGS. 5 and 6.

While a single release rod is shown and described in each of the embodiments discussed above, it is also contemplated that the body jewelry applicator may be adapted to include two or more release rods extending into a hole in a gripping member. For example, the release rod may be forked or may otherwise divide into two release rods adjacent the gripping member, with the two release rod ends extending into the hole in the gripping member to eject a backing of an ear ring. Any of the embodiments discussed above and including a release rod (FIGS. 2-6) may be modified to include two or more release rods extending into the hole in the gripping member.

Figure 7:
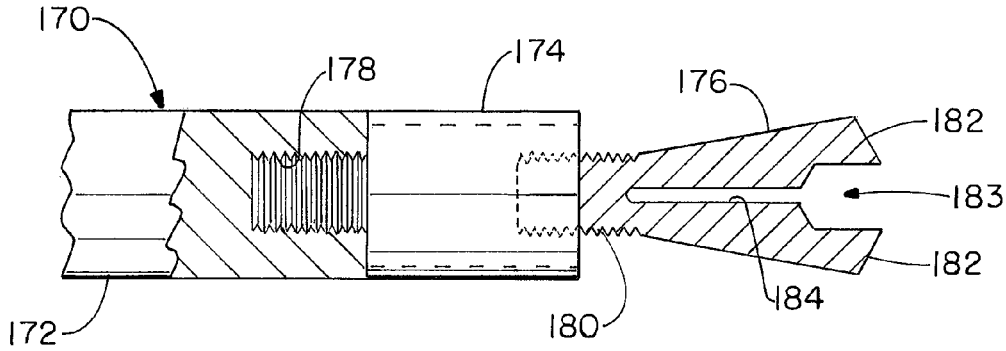
FIG. 7 is a section view of yet another embodiment of the body jewelry applicator according to the concepts of the present invention.

Referring now to FIG. 7, yet another embodiment of the body jewelry applicator is shown and is referred to generally by the numeral 170. Body jewelry applicator 170 includes a body 172, a collar 174, and a compressible collet 176. The body 172 includes a threaded bore 178 that receives a threaded portion 180 of the collet 176 therein. The collet 176 includes a plurality of compressible arms 182 opposite the threaded portion 180, the arms 182 defining an opening 183 adapted to receive a backing of a piece of body jewelry. The arms 182 are positioned around the opening 183, which extends into the collet toward the threaded portion 180. The opening is sized to have a diameter approximately 0.005 inches greater than the diameter of the backing.

A hole 184 extends from the opening 183 further into the collet 176. The hole 184 is adapted to receive the stem or shaft of body jewelry that has a backing secured by a friction fit. The collar 174 is threaded over the exterior of the body 172 around bore 178, and is positioned around the collet 176. Tightening the collar 174 around the collet 176 causes the arms 182 to compress around the backing positioned within the opening 183, thereby gripping the backing and retaining it within the body jewelry applicator 170. The body jewelry applicator may be provided as part of a kit including a plurality of collets 176 having different sized openings 183 for receiving backings of varying sizes.

It is thus evident that a body jewelry applicator constructed as described herein substantially improves the art. Only particular embodiment(s) have been presented and described in detail, and the invention should not be limited by the drawings or the description provided. For an appreciation of the true scope and breadth of the invention, reference should be made only to the following claims.

The invention claimed is:

1. A body jewelry applicator comprising:

(a) a body having a forward end and a rear end, said body including a bore therein with a release rod slidably positioned within said bore;

(b) a foam gripping member having opposing ends, said foam gripping member being secured to said forward end of said body; and (c) a hole in one of said ends of said foam gripping member adapted to receive and retain a jewelry backing therein.

2. The applicator of claim 1, wherein said gripping member is generally cylindrical in shape.

3. The applicator of claim 1, wherein said gripping member is between approximately 0.25 and 2.5 inches in length.

4. The applicator of claim 1, wherein a hole is provided in each of said ends of said foam gripping member, said holes having different diameters.

5. The applicator of claim 1, wherein said gripping member includes a through-bore extending from said hole through said gripping member and aligned with said bore in said body.

6. The applicator of claim 5, wherein said release rod is movable between a first position and a second position, an end of said release rod being positioned adjacent to said hole without extending into said hole in the first position, and said end of said release rod extending into said hole in said second position.

7. The applicator of claim 6, wherein a pushbutton is operatively engaged with said release rod at said rear end of said body, said pushbutton being an actuation mechanism for moving said release rod between said first and second positions.

8. The applicator of claim 7, wherein said release rod is biased by a spring located within said bore.

* * * * *